United States Patent [19]

Kammann, Jr.

[11] Patent Number: 4,921,624

[45] Date of Patent: May 1, 1990

[54] MODIFIED FATTY AMIDES AND SULFURIZED FATTY OILS AS LUBRICANT ADDITIVES

[75] Inventor: Karl P. Kammann, Jr., Crown Point, Ind.

[73] Assignee: Ferro Corporation, Cleveland, Ohio

[21] Appl. No.: 202,736

[22] Filed: Jun. 3, 1988

[51] Int. Cl.[5] ..... C10M 129/00; C10M 133/00

[52] U.S. Cl. ..... 252/48.6; 252/51.5 A; 252/56 R; 252/56 S

[58] Field of Search ..... 252/51.5 A, 47.5, 48.6, 252/56 S, 56 R; 260/404

[56] References Cited

U.S. PATENT DOCUMENTS

| | | | |
|---|---|---|---|
| 2,311,929 | 2/1943 | Chenicek | 44/66 |
| 3,438,898 | 4/1969 | Schlobohm et al. | 252/33 |
| 3,455,896 | 7/1969 | Den Herder | 252/48.6 |
| 4,134,845 | 1/1979 | Wokin | 252/48.6 |
| 4,166,796 | 9/1979 | Recchuite | 252/48.6 |
| 4,201,684 | 5/1980 | Molic | 252/48.6 |
| 4,269,606 | 5/1981 | Bonazza et al. | 252/51.5 A |
| 4,280,915 | 7/1981 | Kercheville | 252/51.5 A |
| 4,380,498 | 4/1983 | Kammann, Jr. et al. | 252/48.6 |
| 4,485,044 | 11/1984 | Kamman, Jr. | 252/48.6 |

*Primary Examiner*—Jacqueline V. Howard
*Assistant Examiner*—Margaret B. Medley
*Attorney, Agent, or Firm*—Philip Hill

[57] ABSTRACT

An improved lubricant additive, for imparting improved friction reduction and anti-wear properties to crankcase oils comprises a modified mixed amide, derived from reaction of a substantially saturated fatty acid triglyceride with a deficiency of dialkanolamine, either alone or in combination with a sulfurized substantially unsaturated fatty acid triglyceride which may be transesterified for improved solubility.

17 Claims, No Drawings

MODIFIED FATTY AMIDES AND SULFURIZED FATTY OILS AS LUBRICANT ADDITIVES

BACKGROUND OF THE INVENTION

The conventional formulation of lubricating oils addresses a number of problems relative to engine crankcase performance and attempts to improve significantly the properties of the normally employed mineral and synthetic oils. In a typical fully compounded mineral lubricating oil some 5 to 15 wt. % of the total composition will consist of additive components imparting improved viscosity, viscosity index, oxidation stability, sludge dispersancy, wear protection, acidity control, and the like.

In recent years more severe Federal standards have been imposed on engine performance in terms of control of combustion emissions and improved energy utilization, measured in terms of miles per gallon. This has resulted in increased demands and stresses upon automotive engines, particularly upon smaller engines at their relatively high operating speeds. For example, particular phosphorus compounds are normally introduced as a component of automotive engine oils to provide wear protection for engine surfaces and parts. However, even at the low levels required for adequate wear protection there are deleterious effects on exhaust system catalytic converters and on the resulting emissions. Similarly, such phosphorus compunds also affect the sensors developed for control of fuel/air ratio in modern engines.

Fuel economy is effected by lessening the friction between moving parts in a combustion engine, particularly by boundary film lubrication. It is often found that desirable anti-wear and friction modification properties do not occur together, probably because of differing sensitivities to chemical components present in the additives in the oil.

To achieve an optimized formulation of lubricating oil, the phosphorus content of the oil should be reduced as much as possible. Presently, the phosphorus is generally present at a level of 0.10–0.12 wt. % in the form of a zinc dialkyldithiophosphate (ZDP). Accordingly, there is a need for a non-phosphorus additive possessing anti-wear properties to permit a significant reduction in the phosphorus content of the lubricating oil. Additionally, such an additive should desirably impart significant friction-reducing properties.

Friction-reducing additives, based on fatty acid amide derivatives have been disclosed. In U.S. Pat. No. 4,208,293, the friction modifier is an amide, based on a fatty acid and diethanolamine. In related U.S. Pat. No. 4,201,684, corresponding amides and/or esters are sulfurized. More recently, U.S. Pat. No. 4,389,322 has employed borated amides and U.S. Pat. No. 4,512,903 has employed hydroxy-substituted fatty acids for reducing friction.

One example of an anti-wear additive is disclosed in U.S. Pat. No. 4,380,499 where a sulfurized triglyceride, transesterified for improved oil solubility, is employed.

SUMMARY OF THE INVENTION

This invention relates to improved lubricant additive compositions and to lubricating oil compositions containing such additives. The lubricant additive compositions of this invention are effective in reducing friction and in reducing wear between moving parts in an internal combustion engine, thus permitting a significant reduction in the use of phosphorus-containing anti-wear agents.

The improved lubricant additive compositions of this invention comprise the mixed amide reaction product of a fatty acid triglyceride with from about 40% to about 70% of the stoichiometric quantity of a dialkanolamine, yielding a mixture of fatty acid mono- and di-glycerides together with the fatty acid dialkanolamide. In a preferred composition, the additive comprises the reaction product of coconut oil and diethanolamine.

The improved lubricant additive compositions of this invention may additionally comprise a sulfurized derivative of a triglyceride whose acid components are largely unsaturated. Such triglycerides may have been transesterified, to improve solubility properties, prior to sulfurization.

The improved lubricating oil compositions of this invention may contain from about 0.1 to about 10.0 wt. % of the additive compositions.

DETAILED DESCRIPTION OF THE INVENTION

This invention relates to improved lubricant additive compositions and to corresponding lubricating oils exhibiting significantly improved properties relative to reduction in both friction and wear. This invention permits a major reduction in the use of phosphorus-containing additives while still further reducing friction and wear. Additionally, sensors which control the fuel-to-air ratio in newer engines are not expected to lose their effectiveness as rapidly because of the lessened content of phosphorus-containing additives.

The improved additive compositons of this invention comprise certain types of modified fatty acid amides, either alone or preferably in combination with certain types of sulfurized triglycerides.

The modified fatty acid amides of this invention are derived from the reaction of a triglyceride with substantially less than the stoichiometric quantity of a dialkanolamine. Preferably, the triglyceride comprises substantially saturated fatty acids having from about 8 to about 18 carbon atoms. A particularly preferred triglyceride is coconut oil. The dialkanolamine may contain alkyl (alkanol) groups having from 2 to 6 carbon atoms. A preferred reactant is diethanolamine.

The amidation reaction proceeds employing only about some 40% to about 70%, preferably about 50% to about 67%, of the stoichiometric amount of the dialkanolamine component. The resulting product generally contains from about 40 to about 70 mole %, preferably from about 50 to about 67 mole %, of fatty acid dialkanolamide, together with a mixture of corresponding mono- and di-glyceride esters. The latter esters are primarily mono-glycerides.

Generally suitable amides may be obtained by the reaction of partially unsaturated glycerides, such as lard oil, but better performance has regularly been observed when employing more saturated glycerides, having shorter chain acids, such as coconut oil.

The sulfurized triglycerides of this invention may be based on any largely unsaturated triglyceride. A preferred example is lard oil. Generally, the triglyceride will comprise from about 35 mole % to about 65 mole % unsaturated fatty acids. Where the selected triglyceride may possibly present problems of oil solubility, pour point, and flow performance, the inclusion of from about 20 to about 45 wt. % of a branched alcohol ester of an unsaturated fatty acid may be effected prior to sulfurization. Alternatively, the selected triglyceride may be transesterified, as described in U.S. Pat. No. 4,380,499, commonly assigned, prior to sulfurization. Such transesterification may be effected by reaction with a saturated aliphatic acid having from 8 to 14 carbon atoms, a primary alcohol having from 8 to 22 carbon atoms, a corresponding fatty ester, or an alcohol-ester or acid-ester mixture. After sulfurization, this component of the additive composition should contain from about 4 to about 14 wt. %, preferably from about 6 to about 10 wt. %, sulfur.

The additive composition of this invention is suitable for use in any crankcase lubricating oil formulation in an amount ranging from about 0.1 to about 10.0 wt. % thereof, preferably from about 0.2 to about 2.0 wt. %. Preferred additive compositions comprise from about 30 to about 60 weight % of the mixed amide component together with from about 40 to about 70 weight % of the sulfurized triglyceride component. A more preferred additive composition comprises about 40 weight % of the mixed amide component and about 60 weight % of the sulfurized triglyceride component.

The following examples are illustrative, without limitation, of the blends and compositions of this invention.

EXAMPLE I

A solvent-extracted neutral paraffinic oil was compounded (without friction modifier) to provide an SAE 10W-40 calcium dispersant-inhibitor system, containing either 0.12 wt. % phosphorus (Oil A-1) or 0.08 wt. % phosphorus (Oil A-2).

EXAMPLE II

A hydrotreated paraffinic oil was compounded (without friction modifier) to provide an SAE 30 calcium-magnesium dispersant-inhibitor system, containing either 0.12 wt. % phosphorus (Oil B-1) or 0.08 wt. % phosphorus (Oil B-2).

EXAMPLE III

Methyl coconate, derived from methanolysis of coconut oil, was heated at 150° C. with an equimolar quantity of diethanolamine, while sparging with nitrogen to remove methyl alcohol as it is formed. The product (Additive C) was a typical "superamide", representative of commercially available cocoamides.

EXAMPLE IV

Oleic diethanolamide was prepared by stirring equimolar quantities of oleic acid and diethanolamine in a nitrogen atmosphere while heating to 182° C. and maintaining the temperature for 2 hours while removing water. The product (Additive D), which also contained a significant amount of ester, was representative of another commercial amide.

EXAMPLE V

A blend of 67 parts prime lard oil, 28 parts coconut oil, and 5 parts oleic acid was heated for 4 hours at 210° C. in the presence of 0.2 wt. % toluenesulfonic acid. To this mixture was added 8 parts of HOE alcohol, a branched primary alcohol mixture, having from 11 to 22 carbon atoms and averaging about 16 carbon atoms, sold commercially as Heavy Oxo Ends. Heating was continued for 3 hours. The resultant product, containing about 87% transesterified triglyceride and about 13% ester, was heated with elemental sulfur at 185° C. for 3 hours, followed by cooling while sparging with air to remove $H_2S$ and light ends. The resultant product (Additive E) contained 6.3% bound sulfur.

EXAMPLE VI

To 45 parts of the unsaturated fatty acid ester of tall oil fatty acids (principally oleic and linoleic acids) and HOE alcohol was added 55 parts of prime lard oil and sulfurized as in Example V. The resultant product (Additive F) contained 9.5% bound sulfur.

EXAMPLE VII

A mixture of 2.0 moles diethanolamine with 1.0 mole prime lard oil was heated at 150 ° C. for 5 hours while sparging with nitrogen to remove water formed in the amidation reaction. The recovered product (Additive 1) contained about 66 mole % amide and 33 mole % glycerides, mainly monoglyceride, with traces of the original reactants.

EXAMPLE VIII

The procedure of Example VII was respeated employing coconut oil to obtain Additive 2 as the recovered product.

EXAMPLE IX

An additive mixture (Additive 3) was prepared by physically blending 40 wt. % of Additive 2 with 60 wt. % of Additive F.

EXAMPLE X

An additive mixture (Additive 4) was prepared by physically blending 40 wt. % of Additive 1 with 60 wt. % Additive F.

EXAMPLE XI

An additive mixture (Additive 5) was prepared by physically blending 40 wt. % of Additive C with 60 wt. % of Additive F.

EXAMPLE XII

An additive mixture (Additive 6) was prepared by physically blending 40 wt. % of Additive 2 with 60 wt. % of Additive E.

The additive products of the preceding Examples were variously blended in proportions ranging from 0.5 to 2.0 wt. % in formulations of either of Oil A or Oil B. These additive formulations were then subjected to Falex procedures for evaluation of performance relative to friction coefficient and to pin wear. In some instances wear-scar was also determined using a four-ball machine.

Falex procedures for evaluating lubricants are described in Lubrication Engineering, vol. 24, no. 8, pages 349–358 (1968). The procedure employed in these tests was as follows, employing #8 test journal pins and vee blocks. The more sensitive torque gauge (0–40 lb.-inches) model was employed with a load gauge having a 0–4500 lbs. reference load scale. After a 2-minute warmup/break-in period at 250 lbs. load, the standard Falex walkup test was followed until 1000 lbs. load was reached. At this point the load was maintained for 15 minutes with the ratchet arm removed. The pin was then cleaned and weighed, with the per cent weight change being reported as pin wear. Torque readings over the middle 5 minutes were used to calculate the coefficient of friction.

This modified Falex procedure provides an effective method for the screening of motor oils and motor oil formulations, especially with regard to the effect of friction modifier agents. The test has been found to correlate very well with engine fuel economy tests.

The four-ball machine for testing for friction and wear is described in the ASTM D-2266 procedure. Tests were conducted at 1800 R.P.M., using a 40 kg. load, for one hour at 350° F. Wear-scar diameters were measured and reported.

Testing results for formulations employing amides alone, sulfurized oils alone, and mixed products according to this invention are presented in Tables I, II and III, respectively.

The amide additives of this invention, particularly Additive 2, exhibit significantly improved properties over those of presently commercially available amide-type formulations, both with respect to improvements in pin wear and friction coefficient. However, much more striking results are exhibited by Additives 3 and 6 which combine the Additive 2 amide component with a sulfurized oil component. Although mileage test data are not available, the magnitude of the improvement in both pin wear and friction coefficient inferentially suggests a significant improvement in engine efficiency and fuel utilization.

TABLE I

| | Amide Additive | | | | |
|---|---|---|---|---|---|
| | | | Falex | | 4-Ball |
| | Additive | | Friction | Pin Wear, | Scar, |
| Oil | No. | wt. % | Coefficient | wt. % | mm. |
| A-1 | — | — | .085 | .156 | 0.69 |
| A-2 | — | — | .093 | .184 | 1.50 |
| A-2 | C | 1.0% | .085 | .165 | — |
| A-2 | D | 1.0% | Failed, 1 min. | | — |
| A-2 | 1 | 1.0% | .084 | .099 | — |
| A-2 | 2 | 1.0% | .072 | .108 | — |
| B-1 | — | — | .101 | .408 | 0.55 |
| B-2 | — | — | Failed, 1 min. | | 1.60 |
| B-2 | C | 0.5% | Failed, 3 mins. | | — |
| B-2 | 2 | 0.5% | .084 | .116 | 0.56 |

TABLE II

| | Sulfurized Oil Additive | | | | |
|---|---|---|---|---|---|
| | | | Falex | | 4-Ball |
| | Additive | | Friction | Pin Wear, | Scar, |
| Oil | No. | wt. % | Coefficient | wt. % | mm. |
| A-2 | — | — | .093 | .184 | 1.50 |
| A-2 | E | 0.5% | .077 | .164 | 0.72 |
| A-2 | E | 1.0% | .068 | .154 | — |
| A-2 | F | 1.0% | .072 | .146 | — |
| A-2 | E | 2.0% | .066 | .133 | 0.57 |
| B-2 | — | — | Failed, 1 min. | | 1.60 |
| B-2 | E | 0.5% | .091 | .111 | 0.61 |
| B-2 | E | 1.0% | .083 | .107 | 0.54 |
| B-2 | F | 1.0% | .082 | .105 | — |

TABLE III

| | Amide & Sulfurized Oil Additive | | | | |
|---|---|---|---|---|---|
| | | | Falex | | 4-Ball |
| | Additive | | Friction | Pin Wear, | Scar, |
| Oil | No. | wt. % | Coefficient | wt. % | mm. |
| A-2 | — | — | .093 | .184 | 1.50 |
| A-2 | 3 | 0.5% | .070 | .122 | 0.65 |
| A-2 | 3 | 1.0% | .079 | .060 | 0.71 |
| A-2 | 3 | 2.0% | .081 | .018 | 0.61 |
| A-2 | 4 | 1.0% | .086 | .082 | — |
| A-2 | 5 | 1.0% | .085 | .155 | — |
| A-2 | 6 | 1.0% | .079 | .062 | — |

TABLE III-continued

| | Amide & Sulfurized Oil Additive | | | | |
|---|---|---|---|---|---|
| | | | Falex | | 4-Ball |
| | Additive | | Friction | Pin Wear, | Scar, |
| Oil | No. | wt. % | Coefficient | wt. % | mm. |
| B-2 | — | — | Failed, 1 min. | | 1.60 |
| B-2 | 3 | 0.5% | .078 | .032 | 0.36 |
| B-2 | 4 | 0.5% | .078 | .048 | 0.36 |
| B-2 | 6 | 0.5% | .076 | .036 | — |

I claim:

1. A modified mixed amide lubricant additive composition, capable of imparting improved friction reduction and anti-wear properties, derived from the reaction of a fatty acid triglyceride with from about 40% to about 70% of the stoichiometric quantity of a dialkanolamine, comprising from about 30 mole % to about 50 mole % of fatty acid di- and mono-glycerides together with from about 50 mole % to about 70 mole % of fatty acid dialkanolamide.

2. The mixed amide composition of claim 1 wherein the fatty acid triglyceride is derived substantially from fatty acids having from about 8 to about 18 carbon atoms.

3. The mixed amide composition of claim 1 wherein the fatty acid triglyceride is derived substantially from saturated fatty acids.

4. The mixed amide composition of claim 1 wherein the fatty acid triglyceride is coconut oil.

5. The mixed amide composition of claim 1 wherein the dialkanolamine is selected to contain alkanol groups having from 2 to 6 carbon atoms.

6. The mixed amide composition of claim 1 wherein the dialkanolamine is diethanolamine.

7. The mixed amide composition of claim 1, derived from the reaction of the fatty acid triglyceride with from about 50% to about 67% of the stoichiometric quantity of diethanolamine, comprising from about 33 mole % to about 50 mole % of fatty acid di- and mono-glycerides together with from about 50 mole % to about 67 mole % of fatty acid diethanolamide.

8. A lubricant additive composition, capable of imparting improved friction reduction and anti-wear properties, comprising:

(a) from about 30 to about 60 weight % of a mixed amide composition, comprising from about 30 to about 50 mole % of fatty acid di- and mono-glycerides together with from about 50 to about 70 mole % of fatty acid dialkanolamide; and (b) from about 40 to about 70 weight % of a sulfurized triglyceride, wherein the acid component of said triglyceride comprises from about 35 to about 65 mole % unsaturated fatty acids and the sulfur content is within the range from about 4 to about 14 weight %.

9. The lubricant additive composition of claim 8 wherein, prior to sulfurization, the triglyceride is transesterified by reaction with a member of the class consisting of saturated aliphatic acids having from 8 to 14 carbon atoms, primary alcohols having from 8 to 22 carbon atoms, fatty acid esters of such acids and alcohols, and mixtures thereof.

10. The lubricant additive composition of claim 8, comprising about 40 weight % of the mixed amide composition together with about 60 weight % of the sulfurized triglyceride.

11. The lubricant additive composition of claim 8 wherein the sulfur content of the sulfurized triglyceride is from about 6 to about 10 weight %.

12. A lubricating oil composition, comprising:

(1) a refined base oil, having lubricating oil viscosity and volatility properties; and (2) a minor amount, from about 0.1 to about 10 wt. % of the lubricating oil composition, of a mixed amide additive composition, derived from the reaction of a fatty acid triglyceride with from about 40% to about 70% of the stoichiometric quantity of a dialkanolamine, said mixed amide additive composition comprising from about 30 mole % to about 50 mole % of fatty acid di- and mono-glycerides together with from about 50 mole % to about 70 mole % of fatty acid dialkanolamide.

13. The lubricating oil composition of claim 12, comprising from about 0.2 to about 2.0 wt. % of the mixed amide additive composition.

14. The lubricating oil composition of claim 12, wherein the mixed amide additive composition is derived from the reaction of coconut oil with diethanolamine.

15. The lubricating oil composition of claim 12, additionally comprising a minor amount, from about 0.1 to about 10 wt. % of the lubricating oil composition, of a sulfurized triglyceride, wherein the acid component of said triglyercide comprises from about 35 to about 65 mole % unsaturated fatty acids and the sulfur content is within the range from about 4 to about 14 weight %.

16. The lubricating oil composition of claim 15 additionally comprising from about 0.2 to about 2.0 wt. % of the sulfurized triglyceride.

17. The lubricating oil composition of claim 15 wherein the sulfurized triglyceride is a transesterified triglyceride.

* * * * *